US008800535B2

(12) United States Patent
Kuchler

(10) Patent No.: US 8,800,535 B2
(45) Date of Patent: Aug. 12, 2014

(54) NOISE-REDUCED ACTUATION METHOD FOR A PIEZOACTUATOR IN AN INJECTOR

(75) Inventor: Robert Kuchler, Regen (DE)

(73) Assignee: Continental Automotive GmbH, Hannover (DE)

( * ) Notice: Subject to any disclaimer, the term of this patent is extended or adjusted under 35 U.S.C. 154(b) by 426 days.

(21) Appl. No.: 13/333,223

(22) Filed: Dec. 21, 2011

(65) Prior Publication Data

US 2012/0174896 A1 Jul. 12, 2012

(30) Foreign Application Priority Data

Dec. 21, 2010 (DE) ..... 10 2010 063 667

(51) Int. Cl.
*F02M 51/06* (2006.01)

(52) U.S. Cl.
USPC ..... 123/494; 123/490; 701/105

(58) Field of Classification Search
USPC ..... 123/472, 478, 480, 490, 494, 498, 500; 701/103–105, 114; 239/102.1, 102.2, 239/533.3, 585.1; 73/114.03, 114.38, 73/114.49
See application file for complete search history.

(56) References Cited

U.S. PATENT DOCUMENTS

| | | | | |
|---|---|---|---|---|
| 4,984,549 | A * | 1/1991 | Mesenich | 123/472 |
| 6,155,500 | A * | 12/2000 | Takase | 239/533.3 |
| 6,619,268 | B2 * | 9/2003 | Rueger et al. | 123/490 |
| 7,709,996 | B2 * | 5/2010 | Hauser et al. | 310/316.03 |
| 7,856,964 | B2 * | 12/2010 | Sykes et al. | 123/490 |
| 7,944,117 | B2 * | 5/2011 | Ripoll et al. | 310/317 |
| 2002/0008440 | A1 * | 1/2002 | Hedenetz et al. | 310/316.03 |
| 2004/0169436 | A1 * | 9/2004 | Fukagawa et al. | 310/317 |
| 2007/0080606 | A1 * | 4/2007 | Hardy et al. | 310/316.03 |
| 2008/0319699 | A1 * | 12/2008 | Perryman | 702/115 |
| 2009/0090333 | A1 * | 4/2009 | Spadafora et al. | 123/494 |
| 2009/0093944 | A1 * | 4/2009 | Sykes et al. | 701/103 |
| 2010/0059021 | A1 * | 3/2010 | Rau et al. | 123/478 |
| 2011/0000465 | A1 | 1/2011 | Stoecklein et al. | 123/478 |

FOREIGN PATENT DOCUMENTS

| | | | | |
|---|---|---|---|---|
| DE | 102005036190 | A1 | 2/2007 | F02D 41/40 |
| EP | 0995899 | A2 | 4/2000 | F02M 47/02 |

* cited by examiner

*Primary Examiner* — John Kwon
*Assistant Examiner* — Johnny H Hoang
(74) *Attorney, Agent, or Firm* — King & Spalding L.L.P.

(57) ABSTRACT

In an actuation method for a piezoactuator in an injector, an injection is triggered by controlling the piezoactuator to open and close the injection valve. An injection charge and discharge pulse each cause a change in length of the piezoactuator, which excites an oscillation system. After an idle time interval without injection, the steps for triggering an injection are repeated. At times $t_1$ and $t_2$ during the idle time interval $t_L$, a damping charge current pulse and a damping discharge current pulse are applied, wherein the change in length which is generated by the damping charge and discharge current pulses are too small to activate the injection valve and to trigger an injection. The times $t_1$ and $t_2$ are selected such that excitation of the oscillation system by the pulses takes place in anti-phase with respect to the oscillation which is excited by the injection charge and discharge current pulse.

11 Claims, 1 Drawing Sheet

NOISE-REDUCED ACTUATION METHOD FOR A PIEZOACTUATOR IN AN INJECTOR

CROSS-REFERENCE TO RELATED APPLICATIONS

This application claims priority to DE Patent Application No. 10 2010 063 667.3 filed Dec. 21, 2010. The contents of which is incorporated herein by reference in its entirety.

TECHNICAL FIELD

The invention relates to an actuation method for a piezoactuator in an injector which is mounted on a cylinder head and has an injection valve. The method comprises the triggering of an injection by applying an injection charge current pulse to the piezoactuator in order to open the injection valve and start an injection, as well as applying an injection discharge current pulse to the piezoactuator in order to close the injection valve and end the injection. The injection charge current pulse and the injection discharge current pulse each bring about a change in length of the piezoactuator, which change in length excites an oscillation system, comprising the injector and the cylinder head, to oscillate. After an idle time interval in which no injection takes place, the steps for triggering an injection are repeated.

BACKGROUND

In known injectors, for example diesel piezo common-rail injectors, an injection valve for injecting fuel into the combustion chamber of the cylinder head is actuated by a piezoactuator. As a result of a voltage being applied to the piezoactuator or as a result of the electrodes of a piezoactuator being charged with a charge current pulse, the piezoactuator experiences a change in length. This change in length is transmitted as an operating stroke to a valve element of the injection valve. In order to close the injection valve, the electrodes of the piezoactuator are discharged with a corresponding discharge current pulse. The change in length is thereby reversed and the movement of the piezoactuator transmitted to the valve element of the injection valve in order to close the valve. These changes in length of the piezoactuator take place in a highly dynamic fashion and generate acceleration forces and mechanical oscillations which, in the installed state on a cylinder head, are audibly transmitted to the injector and the cylinder head. This noise which is caused by the piezoactuator is frequently felt to be disruptive, in particular if it predominates over the combustion noises in the idling mode of the engine.

In the known piezo diesel common-rail systems, attempts have been made to adapt the current profile used for actuating the piezoactuator in such a way that the particularly disruptive, relatively high frequency components of the noise are reduced. For this purpose, for example the charge time of the piezoactuator was increased from 100 microseconds to approximately 180 microseconds. However, in addition to the desired reduction of the disruptive frequency components, the accuracy of the injection quantities, in particular in the very small quantity range, was also adversely affected. Screens, for example in the form of a plastic cover, were introduced as further measures, but said screens only act in the direction of the positioning of the corresponding screen element. The application of the oscillations to the cylinder head or engine and therefore the generation of noise cannot be eliminated with these measures. A further disadvantage of these screening measures is the associated high cost.

SUMMARY

According to various embodiments, a method can be specified with which the undesired generation of noise can be reduced.

According to an embodiment, an actuation method for a piezoactuator in an injector which is mounted on a cylinder head and has an injection valve, may comprise the steps:— triggering of an injection by applying an injection charge current pulse to the piezoactuator in order to open the injection valve and start an injection, and applying an injection discharge current pulse to the piezoactuator in order to close the injection valve and end the injection;

wherein the injection charge current pulse and the injection discharge current pulse each bring about a change in length of the piezoactuator, which changes in length excite an oscillation system, comprising the injector and the cylinder head, to oscillate;—repetition of the steps for triggering an injection after an idle time interval in which no injection takes place;—applying a damping charge current pulse to the piezoactuator at a time $t_1$, and a damping discharge current pulse at a time $t_2$ during the idle time interval, wherein the changes in length of the piezoactuator which are generated by the damping charge current pulse and the damping discharge current pulse are too small to activate the injection valve and to trigger an injection, and wherein the times $t_1$ and $t_2$ are selected such that excitation of the oscillation system by the damping charge current pulse and the damping discharge current pulse takes place in anti-phase with respect to the oscillation which is excited by the injection charge current pulse and the injection discharge current pulse.

According to a further embodiment, the idle time interval can be defined by the end of an injection discharge current pulse and the start of the subsequent injection charge current pulse, and the time $t_1$ is in the first third of the idle time interval. According to a further embodiment, the control of the damping charge pulse and of the damping discharge current pulse can be regulated by a control unit which also carries out the actuation of the injection charge current pulse and of the injection discharge current pulse.

BRIEF DESCRIPTION OF THE DRAWINGS

The invention will be explained in more detail below with reference to FIGS. 1 and 2, in which, in a schematic form.

DETAILED DESCRIPTION

Figure 1:
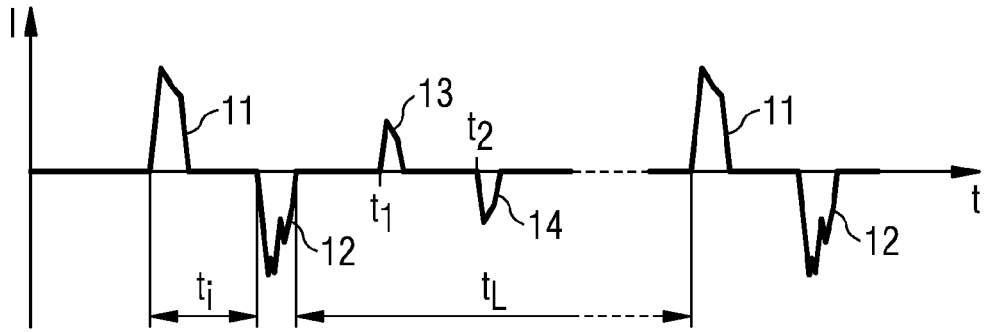
FIG. 1 shows the piezoenergization (charge current of the piezoactuator) as a function of the time.

According to the actuation method according to various embodiments for a piezoactuator in an injector which is mounted on a cylinder head and has an injection valve, an injection is triggered by applying an injection charge current pulse to the piezoactuator in order to open the injection valve and start an injection. The injection valve is closed and the injection ended by applying an injection discharge current pulse to the piezoactuator. The injection charge current pulse and the injection discharge current pulse each bring about a change in length of the piezoactuator, which changes in length excite an oscillation system, comprising the injector and the cylinder head, to oscillate. After an idle time interval in which no injection takes place, the steps for triggering the injection are repeated. According to various embodiments, during the idle time interval, a damping charge current pulse and a damping discharge current pulse are applied to the piezoactuator at the time $t_1$ and at the time $t_2$. The damping charge current pulse and damping discharge current pulse likewise generate changes in length of the piezoactuator, but said changes in length are too small to activate the injection valve and to trigger an injection. According to various embodiments, the times $t_1$ and $t_2$ during the idle time interval are selected such that excitation of the oscillation system by the damping charge current pulse and the damping discharge current pulse takes place in anti-phase with respect to the oscillation which is excited by the injection charge current pulse and the injection discharge current pulse.

Both the injection charge current pulse and the injection discharge current pulse bring about a change in length of the piezoactuator, which change in length applies a pulse to the oscillation system with the injector and cylinder head. The system is already excited to experience natural oscillation at a frequency which is typical of the system by the injection charge current pulse. After a time interval $t_i$ (injection time) after the start of the injection charge current pulse, the injection discharge current pulse is applied to the piezoactuator and as a result the injection is ended. Renewed excitation of the oscillation system is also brought about by this injection discharge current pulse. Depending on the duration of the interval $t_i$, the amplitude of the natural oscillation varies depending on whether the excitation takes place in anti-phase or in phase with the already existing oscillation. A reduction in the oscillation amplitude could therefore be achieved in principle by adaptation of the injection period $t_i$. However, the injection period, by means of which the quantity of the injected fuel is also controlled, should preferably be freely selectable.

Therefore, in order to reduce the oscillation amplitude of the excited natural oscillations, according to various embodiments, an additional damping charge current pulse and a damping discharge current pulse are applied to the piezoactuator between two injections. The amplitude or duration of the damping charge current pulse and of the damping discharge current pulse are shorter here than those of the injection charge current pulses and those of the injection discharge current pulses, with the result that the change in length of the piezoactuator which is brought about as a result is not sufficient to activate the injection valve. This is intended to prevent an additional injection between the injections which are actually provided from taking place. The piezoactuator in an injector usually has a certain idle travel which has to be overcome before the actuator movement triggers a movement of the valve element. The damping charge current pulse and the damping discharge current pulse are therefore small enough for the resulting change in length of the actuator to take place within the limits of the idle travel.

Nevertheless, the change in length of the piezoactuator as a result of the damping charge current pulse and the damping discharge current pulse brings about excitation of the oscillation system with the injector and cylinder head. The times of the damping charge current pulse and of the damping discharge current pulse are selected such that the excitation of the oscillation system takes place in anti-phase with respect to the oscillation which is excited by the injection charge current pulses and injection discharge current pulses. As a result of the anti-phase actuation of the oscillation system, the oscillation is damped and the amplitude is reduced. This leads to a significant reduction in the audible noise.

According to one embodiment of the method, the damping charge current pulse and the damping discharge current pulse take place relatively shortly after the end of the injection after the injection discharge current pulse. This can ensure that the disruptive natural oscillation is already reduced in amplitude after a short time, with the result that the noise can be reduced earlier. The times t1 and t2 of the damping charge current pulse and of the damping discharge current pulse preferably occur in the first third of the idle time interval $t_L$. The idle time interval $t_L$ starts at the end of an injection discharge current pulse and ends at the start of a subsequent injection charge current pulse.

The actuation of the piezoactuator with the damping charge current pulse and the damping discharge current pulse can preferably be carried out by the already existing actuation electronics in the vehicle with the result that the control of the damping charge current pulse and of the damping discharge current pulse is regulated by a control unit which also carries out the actuation of the injection charge current pulse and of the injection discharge current pulse.

In contrast to classic approaches, such as using vibration-isolating and sound-insulating elements, according to various embodiments, the physical laws of vibration are therefore advantageously utilized to reduce the sound, and the already existing actuation electronics in the vehicle are used for this purpose.

FIG. 1 shows the application of current to the piezoactuator plotted against the time with two successive injection processes which start in each case with an injection charge current pulse 11. After a time interval $t_i$, an injection discharge current pulse 12 occurs which brings about closing of the injection valve and ends the injection. The injection discharge current pulse 12 is followed by an idle time interval $t_L$ in which no injection takes place, before a renewed injection is started with a renewed injection charge current pulse 11. In the idle time interval $t_L$, a damping charge current pulse 13 is applied to the piezoactuator at the time $t_1$, and a damping discharge current pulse 14 is applied to the piezoactuator at the time $t_2$. The charge quantities which are moved by the damping charge current pulse 13 and the damping discharge current pulse 14 are not large enough to change the length of the piezoactuator to such an extent that the injection valve is activated. The changes in length of the piezoactuator by the two damping pulses 13 and 14 are smaller than the idle travel provided in the injector. The times $t_1$ and $t_2$ of the two damping pulses 13 and 14 are selected such that the oscillation which is excited as a result at the oscillation system comprising the injector and the cylinder head is in anti-phase with respect to the oscillation which is excited by the injection pulses 11 and 12.

Figure 2:
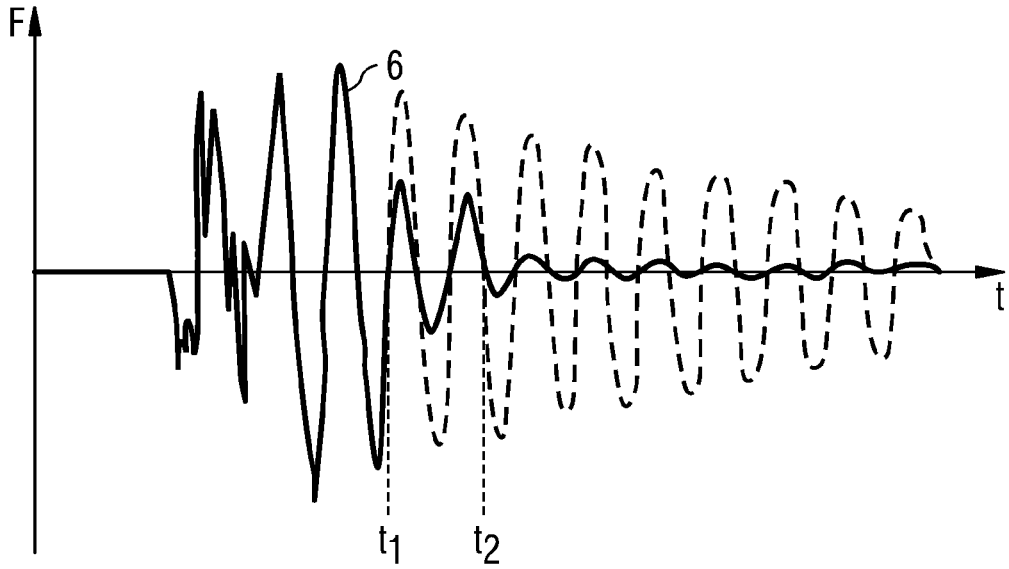
FIG. 2 shows the reaction forces and oscillations at the injector at the interface for the cylinder head which are caused by the piezoactuator.

FIG. 2 shows the acceleration forces acting at the interface between the injector and the cylinder head. The oscillation 6 which is excited by the oscillation excitation of the injection pulses 11 and 12 initially has a high amplitude which slowly decreases over time owing to damping, for example owing to friction, up to the next injection. When the damping pulse 13 starts at the time $t_1$ and the damping discharge pulse 14 starts at the time $t_2$, the amplitude of the oscillation is significantly reduced, as is apparent from the unbroken line in FIG. 2. The conventional profile of the oscillations without the damping pulses 13 and 14 according to various embodiments is represented by dashed lines in FIG. 2.

What is claimed is:

1. An actuation method for a piezoactuator in an injector which is mounted on a cylinder head and has an injection valve, comprising the steps:

triggering of an injection by applying an injection charge current pulse to the piezoactuator in order to open the injection valve and start an injection, and applying an injection discharge current pulse to the piezoactuator in order to close the injection valve and end the injection;

wherein the injection charge current pulse and the injection discharge current pulse each bring about a change in length of the piezoactuator, which changes in length excite an oscillation system, comprising the injector and the cylinder head, to oscillate;

repetition of the steps for triggering an injection after an idle time interval in which no injection takes place;

applying a damping charge current pulse to the piezoactuator at a time $t_1$, and a damping discharge current pulse at a time $t_2$ during the idle time interval, wherein the changes in length of the piezoactuator which are generated by the damping charge current pulse and the damping discharge current pulse are too small to activate the injection valve and to trigger an injection, and wherein the times $t_1$ and $t_2$ are selected such that excitation of the oscillation system by the damping charge current pulse and the damping discharge current pulse takes place in anti-phase with respect to the oscillation which is excited by the injection charge current pulse and the injection discharge current pulse.

2. The actuation method for a piezoactuator according to claim 1, wherein the idle time interval is defined by the end of an injection discharge current pulse and the start of the subsequent injection charge current pulse, and the time $t_1$ is in the first third of the idle time interval.

3. The actuation method for a piezoactuator according to claim 1, wherein the control of the damping charge pulse and of the damping discharge current pulse is regulated by a control unit which also carries out the actuation of the injection charge current pulse and of the injection discharge current pulse.

4. A system for controlling a piezoactuator in an injector which is mounted on a cylinder head and has an injection valve, comprising a control unit operable:

to trigger an injection by controlling the piezoactuator to open and close the injection valve, wherein opening and closing the injection valve bring about a change in length of the piezoactuator, which changes in length excite an oscillation system, comprising the injector and the cylinder head, to oscillate;

to repeat triggering an injection after an idle time interval in which no injection takes place;

to apply a damping charge current pulse to the piezoactuator at a time $t_1$, and a damping discharge current pulse at a time $t_2$ during the idle time interval, wherein the changes in length of the piezoactuator which are generated by the damping charge current pulse and the damping discharge current pulse are too small to activate the injection valve and to trigger an injection, and wherein the times $t_1$ and $t_2$ are selected such that excitation of the oscillation system by the damping charge current pulse and the damping discharge current pulse takes place in anti-phase with respect to the oscillation which is excited by the injection charge current pulse and the injection discharge current pulse.

5. The system according to claim 4, wherein an injection is caused by applying an injection charge current pulse to the piezoactuator in order to open the injection valve and start an injection, and applying an injection discharge current pulse to the piezoactuator in order to close the injection valve and end the injection.

6. The system according to claim 4, wherein the idle time interval is defined by the end of an injection discharge current pulse and the start of the subsequent injection charge current pulse, and the time $t_1$ is in the first third of the idle time interval.

7. The system according to claim 1, wherein the control of the damping charge pulse and of the damping discharge current pulse is regulated by a control unit which also carries out the actuation of the injection charge current pulse and of the injection discharge current pulse.

8. A method for actuating a piezoactuator in an injector which is mounted on a cylinder head and has an injection valve, comprising the steps of:

triggering an injection by controlling the piezoactuator to open and close the injection valve, wherein opening and closing the injection valve bring about a change in length of the piezoactuator, which changes in length excite an oscillation system, comprising the injector and the cylinder head, to oscillate;

repeating triggering an injection after an idle time interval in which no injection takes place;

applying a damping charge current pulse to the piezoactuator at a time $t_1$, and a damping discharge current pulse at a time $t_2$ during the idle time interval, wherein the changes in length of the piezoactuator which are generated by the damping charge current pulse and the damping discharge current pulse are too small to activate the injection valve and to trigger an injection, and wherein the times $t_1$ and $t_2$ are selected such that excitation of the oscillation system by the damping charge current pulse and the damping discharge current pulse takes place in anti-phase with respect to the oscillation which is excited by the injection charge current pulse and the injection discharge current pulse.

9. The method according to claim 8, wherein an injection is caused by applying an injection charge current pulse to the piezoactuator in order to open the injection valve and start an injection, and applying an injection discharge current pulse to the piezoactuator in order to close the injection valve and end the injection.

10. The method according to claim 8, wherein the idle time interval is defined by the end of an injection discharge current pulse and the start of the subsequent injection charge current pulse, and the time $t_1$ is in the first third of the idle time interval.

11. The method according to claim 8, wherein the control of the damping charge pulse and of the damping discharge current pulse is regulated by a control unit which also carries out the actuation of the injection charge current pulse and of the injection discharge current pulse.

* * * * *